US006307320B1

(12) United States Patent
Fuse et al.

(10) Patent No.: US 6,307,320 B1
(45) Date of Patent: Oct. 23, 2001

(54) HIGH PRESSURE DISCHARGE LAMP WITH BENT TIP ELECTRODES

(75) Inventors: Tetsuo Fuse, Kurashiki; Youichi Kouno, Takasago, both of (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/302,296

(22) Filed: Apr. 30, 1999

(30) Foreign Application Priority Data

Apr. 30, 1998 (JP) ..... 10-134217

(51) Int. Cl.[7] ..... H01J 17/04

(52) U.S. Cl. ..... 313/634; 313/331; 313/628; 313/631; 313/632

(58) Field of Search ..... 313/634, 610, 313/573, 17, 631, 491, 492, 493, 628, 632, 633, 326, 331, 332

(56) References Cited

U.S. PATENT DOCUMENTS 4,710,638 12/1987 Wood .
5,600,205 2/1997 Foss et al. .

FOREIGN PATENT DOCUMENTS 297 02 002 U 6/1997 (DE) .
0 415 398 3/1991 (EP) .
2 282 482 4/1995 (GB) .
2-111475 4/1990 (JP) .
5-82093 4/1993 (JP) .
6-144885 5/1994 (JP) .
7-192704 7/1995 (JP) .

OTHER PUBLICATIONS

Patent Abstracts of Japan, vol. 017, No. 411 (E–1406), Jul. 30, 1993 & JP 05 082084 A (Toshiba Lighting & Technol Corp), Apr. 2, 1993 *Abstract*.

Patent Abstracts of Japan, vol. 018, No. 326, (E–1565), Jun. 21, 1994, & JP 06 077345 A (Toshiba Corp), Mar. 18, 1994 *Abstract*.

*Primary Examiner*—Michael H. Day
*Assistant Examiner*—Joseph Williams
(74) *Attorney, Agent, or Firm*—Nixon Peabody LLP; David S. Safran

(57) ABSTRACT

A high pressure discharge lamp in which the total length of the discharge tube can be shortened without changing the discharge length of the electrodes by the ends of a fused silica glass discharge tube having hermetically sealed portions being bent essentially at right angles relative to a discharge part of the discharge tube so that it has an essentially overall angled shape and by there being electrodes with bent end parts within the discharge tube, the electrodes further having base points that are wound with coils of emissive material, and with these coils projecting partially into the discharge space with the remaining parts of the coils being located within the hermetically sealed portions.

2 Claims, 1 Drawing Sheet

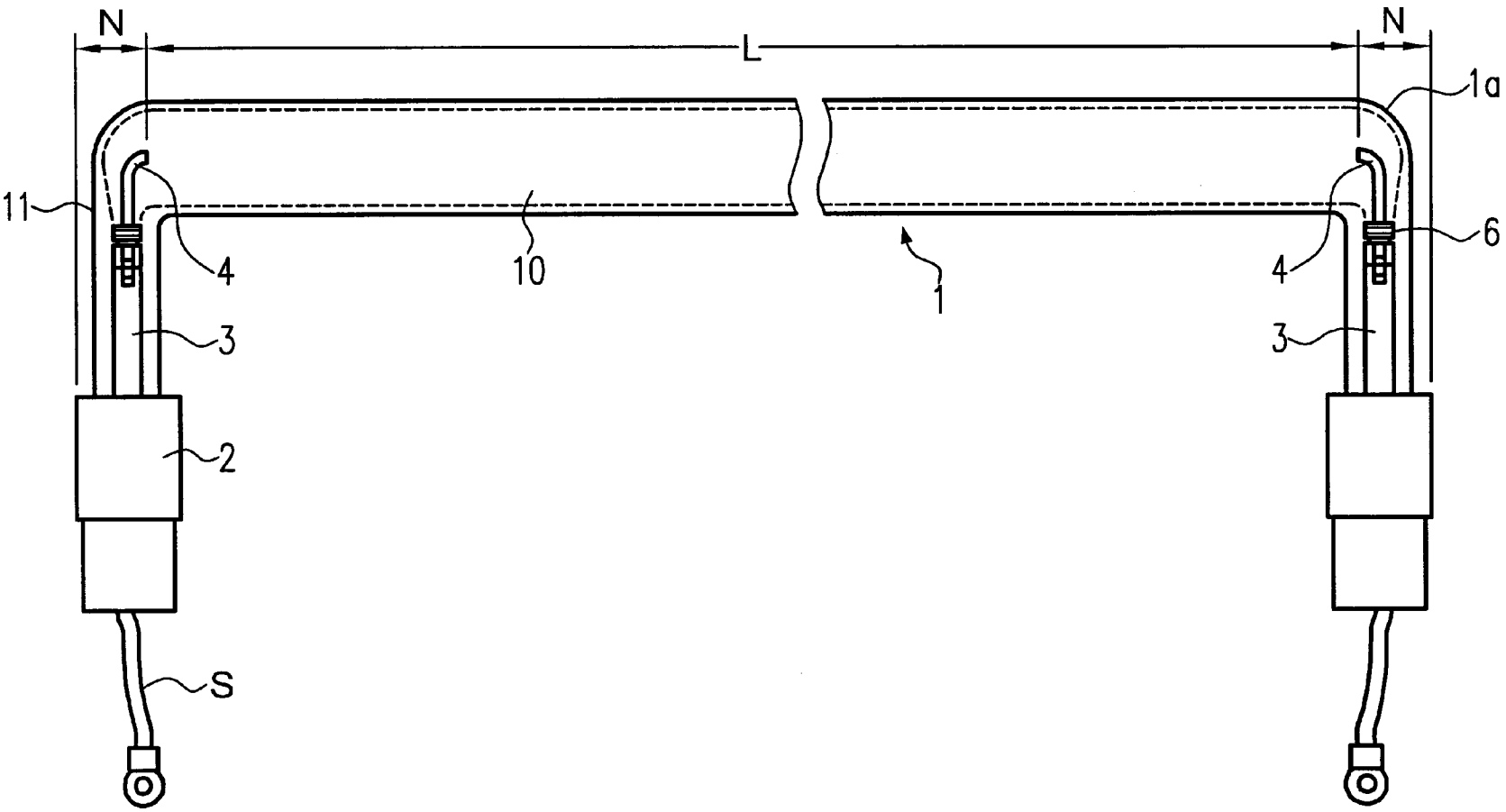
1a
6
N
4
3
1
L
10
4
3
2
S
N
11

HIGH PRESSURE DISCHARGE LAMP WITH BENT TIP ELECTRODES

BACKGROUND OF THE INVENTION

1. Field of the Invention

The invention relates to a high pressure discharge lamp. The invention relates especially to a high pressure discharge lamp which is used for an ultraviolet curing device or the like.

2. Description of Related Art

Conventionally, for a light source of a UV curing device in which resin and ink are cured by UV radiation, a high pressure discharge lamp is used. This high pressure discharge lamp is used, for example, also for a device in which coating material which is applied to optical fibers is cured. Such a curing device is disclosed, for example, in Japanese patent disclosure document HEI 2-111475, Japanese patent disclosure document SHO 62-229202, and Japanese patent disclosure document HEI 6-144885.

One such device for curing of coating material which is applied to optical fibers allows the optical fibers to run up and down. For this reason, therefore, a high pressure discharge lamp with a great length is used. The high pressure discharge lamp is located parallel to the optical fibers. To achieve high working efficiency, several such devices are used which are arranged on top of one another in the direction in which the optical fibers run (specifically up and down).

However, due to the height limitation in the plant or for other reasons these devices cannot always be easily placed on top on one another more than once. Therefore, the number of devices and also the number of light sources used cannot be increased at will. Accordingly, in the light sources used for these devices, i.e. in the high pressure discharge lamps, there is a demand for shortening of the entire length of the discharge tube without changing the length between the electrodes.

A device for curing a coating material applied to optical fibers was described above by way of example. However, not only in this device, but also for other purposes, is there a need to shorten the total length of the discharge lamp without changing the length between the electrodes. This means that there is a need for a lamp in which the length "total length of the discharge lamp relative to the length between the electrodes" is shortened as much as possible.

Japanese patent disclosure document HEI 5-82093 discloses a U-shaped discharge lamp in which the discharge part is bent. Here, it is a sodium discharge lamp which is used for interior illumination or similar purposes, a reduction in the size of the overall lamp being desired. It is, therefore, not a lamp with a great length between the electrodes.

SUMMARY OF THE INVENTION

The primary object of the present invention is to devise a high pressure discharge lamp in which the length between the electrodes is large and the remaining lamp is made as short as possible.

According to the invention, in a high pressure discharge lamp in which the two ends of a fused silica glass discharge tube are bent essentially at right angles and have hermetically sealed portions, and which has an essentially overall angled shape, the object is achieved by there being electrodes with bent tips within the discharge lamp, by the electrodes being wound with coils of emissive material, and by these coils projecting at least partially into the discharge space and the other parts of the coils being inserted into the hermetically sealed portions.

In the following, the invention is further described using the embodiment shown in the drawings.

BRIEF DESCRIPTION OF THE DRAWINGS

The sole FIGURE is a schematic depiction of a high pressure discharge lamp in accordance with a preferred embodiment of the invention.

DETAILED DESCRIPTION OF THE INVENTION

In the figure, a fused silica glass discharge tube is labeled 1. On the two ends of the discharge part 10 with a great length L there are hermetically sealed portions 11 which are bent essentially at right angles with respect to the discharge part 10. Bases 2 of ceramic or similar material are connected to the ends of the hermetically sealed portions 11.

Within the hermetically sealed portions 11, molybdenum metal foils 3 are inserted to which the electrodes 4 are connected. The outer leads 5 are connected to the other ends of the metal foils 3.

One such high pressure discharge lamp has, for example, a rated voltage of 500 V and a rated output of 7 kW. The total length (L+2N) of the discharge tube 1 is 260 mm. The length of the electrodes in the discharge part 10 is roughly 245 mm. This means that the length of the electrodes in the discharge part (hereafter, the discharge length of the electrodes) is 94% of the total length of the discharge tube.

Besides mercury, this discharge tube 1 is filled with metals such as thallium, iron and the like in the form of iodides and/or bromides. For example, iron, mercury iodide, thallium iodide, and mercury are added and radiation with wavelengths of 220 nm to 400 nm is produced. The operating pressure in the discharge tube is 1 to 5 atm.

The electrodes 4 are bent at the end parts of the discharge tube 1 so as to extend into the hermetically sealed portions 11. The tip surface of one of the electrodes is opposite that of the other electrode. The reason for this bending of the end parts of the electrodes 4 is as follows:

In the case in which the electrodes are not bent, but are made straight, electrons do not proceed unconditionally from the electrode ends to their tips, but in many cases emerge from unwanted locations. Therefore, the problem arises that an advantageous arc discharge is not obtained. On the other hand, the lamp itself cannot be produced when the electrodes 4 are bent too much. In the production process specifically, an assembly comprised of electrodes 4, the metal foils 3 and the outer leads 5 is inserted into bent fused silica glass which is then sealed. In this way, hermetically sealed portions 11 are formed. Therefore, in the case in which bending of the electrodes 4 takes place to the extent to which the inside diameter of the discharge tube is reached or exceeded, it is difficult to insert the assembly into the discharge tube.

The electrodes 4, for example, have an outside diameter of 2.0 mm and are made of tungsten. They extend to the middle of the hermetically sealed portion 11 which is essentially at a right angle to the discharge portion 10. The end parts of the electrodes 4 each have a bend with curvature which is roughly equal to the curvature 1*a* of the hermetically sealed portions 11 of the discharge tube 1.

The base points of the electrodes 4 are wound with coils 6 which are made of an emissive material such as, for example, thoriated tungsten. These coils 6 project partially into the discharge space, while the other parts thereof are inserted into the hermetically sealed portions. The discharge is started by emission of electrons 4 from these coils 6. Therefore, it is necessary for the coils 6 to project at least partially into the discharge space.

On the other hand, if the coils 6 project fully into the discharge space, the added metals penetrate into the areas in which the base points of the electrodes 4 are welded to the fused silica glass. In this case, the added metals which have penetrated do not vaporize in the discharge space, because these areas have a low temperature. One such phenomenon causes an imbalance of the added metal; this causes the disadvantages of a change of the radiation wavelengths and a reduction of the emission of the UV radiation after a short time as a result of blackening of the discharge tube.

The coils have, for example, an outside diameter of 0.6 mm and are wound roughly twice. In this way, overall, the coils 6 have a length of 5.0 mm and an outside diameter of 4.4 mm, 0.3 mm of which projects into the discharge space.

These coils 6 must have a certain length with respect to the production process. It is not possible to wind a coil in such minimal dimensions as would be adequate for electron emission when the discharge starts.

In accordance with the invention, the coils are partially inserted into the fused silica glass. This measure increases the temperature of the above described areas, and furthermore, the above described undesirable penetration of the added metals can be advantageously prevented.

In the high pressure discharge lamp according to the invention, the total length of the discharge tube can be shortened without changing the discharge length of the electrodes by bending the hermetically sealed portions essentially at right angles on the two ends of the discharge tube. Furthermore, an advantageous discharge is enabled by bending the electrode end parts. In addition, in accordance with the invention undesirable penetration of the added emission metals into the hermetically sealed portions can be prevented by the coils with which the electrodes are wound being partially inserted into the hermetically sealed portions.

While a single embodiment in accordance with the present invention has been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. High pressure discharge lamp, comprising a fused silica glass discharge tube having opposite end parts with hermetically sealed portions, the end parts being bent at essentially right angles relative to a discharge part of the discharge tube which extends therebetween so that the discharge tube has an overall angled shape; and a pair of electrodes located within the discharge tube, the electrodes having bent end parts and base points that are wound with coils of emissive material, and said coils partially projecting into a discharge space of the discharge part and other parts of the coils being disposed within the hermetically sealed portions, and said electrodes being connected to outer leads via metal foils sealed in said hermetically sealed portions.

2. High pressure discharge lamp according to claim 1, wherein the bent end parts of the electrodes are at free ends thereof which are directed toward each other within the discharge space.

* * * * *